United States Patent [19]

White

[11] 4,438,904

[45] Mar. 27, 1984

[54] DRAWWORKS

[76] Inventor: Bobby E. White, P.O. Box 1137, New Iberia, La. 70560

[21] Appl. No.: 337,748

[22] Filed: Jan. 7, 1982

[51] Int. Cl.[3] ..... B66D 1/14; B66D 1/20; B66D 1/26; B66D 5/00

[52] U.S. Cl. ..... 254/311; 254/358; 254/377; 254/378

[58] Field of Search ..... 254/311, 377, 378, 358

[56] References Cited

U.S. PATENT DOCUMENTS

| | | | |
|---|---|---|---|
| 1,179,612 | 4/1916 | Clarkson | 254/311 X |
| 2,505,088 | 4/1950 | Athy | 254/311 X |
| 2,602,635 | 7/1952 | Young | 254/311 |
| 2,678,190 | 5/1954 | Crake | 254/311 X |
| 2,703,161 | 3/1955 | Keim et al. | 254/311 X |
| 2,775,429 | 12/1956 | Ashton | 254/311 X |
| 3,033,528 | 5/1962 | Wilson | 254/311 X |

*Primary Examiner*—John Petrakes

[57] ABSTRACT

Drawworks, having a single outboard brake on the drum shaft at the driller side of the drawworks instead of the pair of brakes conventionally provided at the drum ends, whereby the brake is more readily accessible for service and repairs than are the brakes of conventional apparatuses.

4 Claims, 5 Drawing Figures

DRAWWORKS

BACKGROUND OF THE INVENTION

A drawworks is a power transmission apparatus used in connection with the drilling of oil and other petroleum wells. The drawworks includes a winch or hoist which is used for lowering pipe into a well and for withdrawing pipe from a well, as well as other power supplying elements, such as for rotation of the rotary drilling table, and the making up and disconnecting of threaded joints between pipes. The power for a drawworks is supplied by one or more engines, or by one or more electric motors. Drawworks include a power input shaft which is driven by the engines or electric motors, and from which power is taken to drive a cable drum shaft in rotation, the cable of which is run over various sheaves pulleys to lower and raise well pipe in the well, and a so-called cat shaft which had so called cathead fittings at one or both ends and is used to engage ropes employed for threading and unthreading threaded joints between pipe lengths, and a rotary shaft which is used to rotate the rotary table of the drilling apparatus. Various clutches are included in the drawworks apparatus for the purpose of connecting shafts for rotation and for releasing the shafts to be nonrotated. The clutches of the drawworks are usually air actuated. The drum shaft carries a drum or spool used to carry a length of cable wound thereon, and, in conventional drawworks equipment, is provided with a pair of brakes, one at each end of the drum. The brakes are provided to resist paying out of the cable from the drum. The brakes are usually of a type including a cylindrical outwardly facing braking surface against which a series of brake blocks fixed on a brake band are forced by operation of a lever to tighten the brake band about the braking surface. The conventional apparatus includes an equalizer bar so that one lever operates both brakes and so that the braking pressures of each brake are substantially equal. This arrangement has resulted in at least one of the brakes being relatively inexcessible for inspection, servicing or repair by the workmen on the drilling platform. The brakes are exposed to relatively severe service, since they must be capable of resisting high pipe loads suspended from the cable and for stopping of such loads from moving to stopped conditions. This invention seeks to provide a drawworks apparatus wherein the drum shaft brake is more accessible for examination and repair than is the case with conventional drawworks apparatuses.

SUMMARY OF THE INVENTION

According to the invention, drawworks apparatus is provided wherein only a single brake is provided for the cable drum, and where the single brake is disposed at the driller's side of the drawworks apparatus to be easily accessible for examination, service, and repair. The driller side of the drawworks is the side from which the driller operates the rig, and the front of the drawworks faces the rig floor and rotary table. Instead of there being a pair of brakes, one at each end of the cable drum, as in conventional drawworks apparatus, only one brake is provided at the end of the cable drum shaft facing the driller's side of the drawworks. The drawworks apparatus is thereby considerably simplified and rendered more satisfactory in service.

A principal object of the invention is to provide drawworks apparatus having a single cable drum brake located at the driller's side of the drawworks. A further object of the invention is to provide such apparatus having an input shaft, a cable drum shaft, a rotary shaft for operation of the rotary table, and a cathead shaft for use in making up and disconnecting threaded pipe joints, and having suitable transmission means for control of the rotational speeds of the various shafts. A further object of the invention is to provide such apparatus which is easily operated and which is economical and serviceable.

Other objects and advantages of the invention will appear from the following detailed description of a preferred embodiment of apparatus according to the invention, reference being made to the accompanying drawings.

BRIEF DESCRIPTIONS OF THE DRAWINGS

DESCRIPTION OF THE PREFERRED EMBODIMENT

Figure 1:
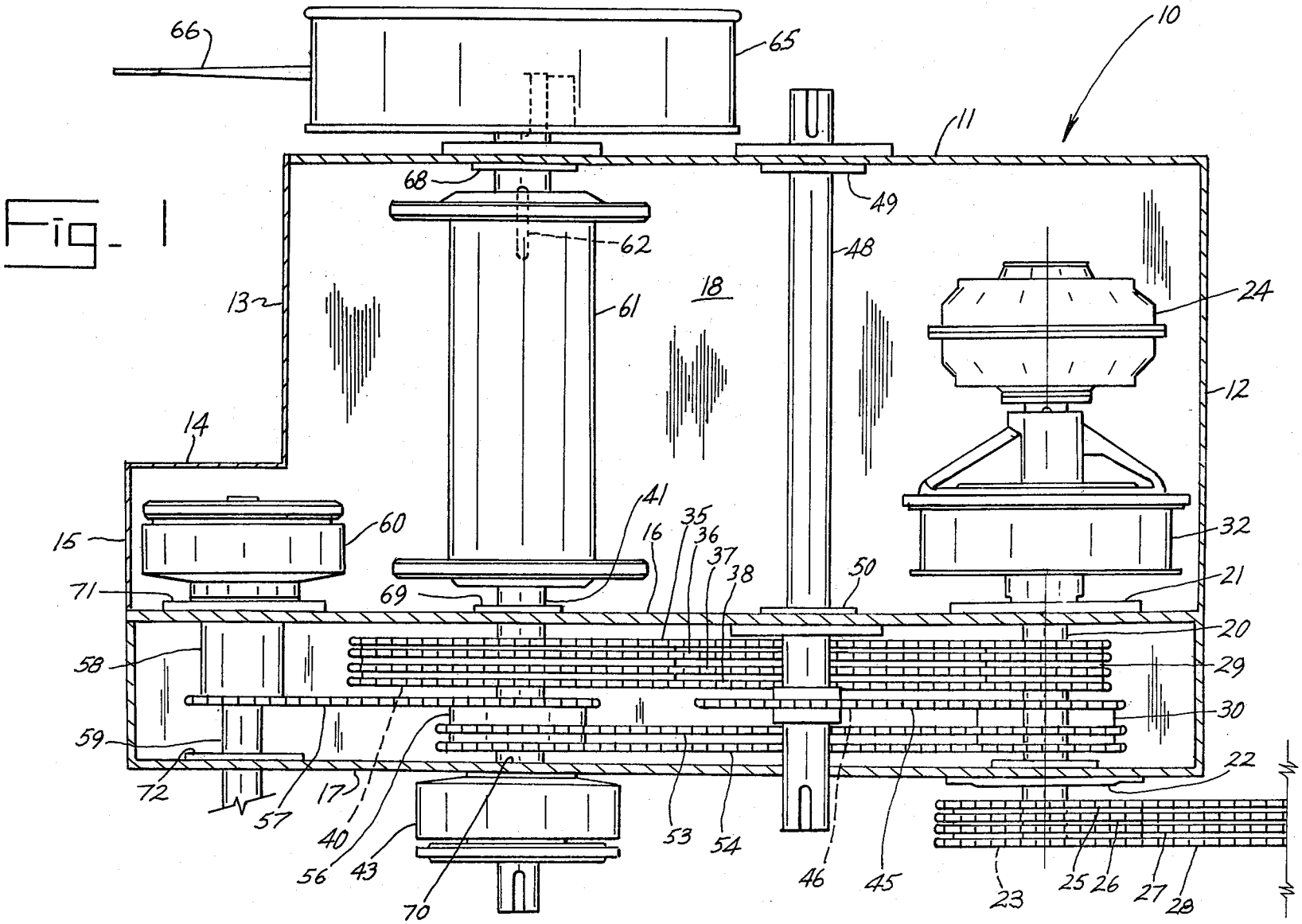
FIG. 1 is a plan view of a preferred form of apparatus according to the invention, being partly in horizontal cross section.

Referring now to the drawings in detail, the housing 10 for the drawworks apparatus is formed of various panels and walls 11–18 formed of steel plate and/or sheet metal depending on the strength requirement of each panel or wall. The panels or walls 11–18 have various access doors therethrough some of which will be referred to later on in the description. An input shaft 20 is suitably journaled for rotation at bearing devices 21–22. Shaft 20 carries a chain sprocket 23 at one end and a hydromatic brake device, 24 at its opposite end. One quad chain, chain 25–28, is engaged with plural chain sprocket 23 and this chain is also pulled or rotated by a suitable engine or motor or plural engines and motors (not shown) for providing rotative power to the apparatus. Quadruple chain sprocket 29 is operated by an air clutch (not shown) disposed interiorly of clutch 32 and a triple chain sprocket 30 is keyed on shaft 20 and pulls sprocket 56 on shaft 41. When clutch 43 is engaged, shaft 41 and drum 61 are rotated at high speed. Sprocket 40 is keyed to shaft 41. Sprocket 29 is mounted on free wheeling bearings, and is connected to a low drum clutch which is located interiorly of clutch 32. Clutch 32 operates hydromatic brake 24. Sprocket 29 is engaged by four drive chains 35–38 which also engage around quadruple chain sprocket 40 carried by drum shaft 41. Sprocket 56 is mounted on live bearings and is connected to clutch 43 and when clutch 43 is engaged it rotates the drum shaft assembly in high gear (at high speed).

One circular tooth assembly of sprocket 30 is engaged by drive chain 45 which is also engaged around a chain sprocket 46 carried by cathead shaft 48. Shaft 48 is journaled for rotation through suitable bearings 49, 50. Shaft 48 is normally provided with cathead fittings (not shown) at its opposite ends adapted to be engaged by a pull rope used for tightening and untightening threaded pipe joints in use of the drawworks apparatus. Drive chains 53, 54 engage around the other two sprocket assemblies of sprocket 30 and around two of the sprocket ssemblies of chain sprocket 56. Sprockets 40 and 56 are on shaft 41 which is controlled by clutch 43, previously mentioned. The third sprocket array of sprocket 56 is engaged by drive chain 57 which is also engaged around single chain sprocket 58 mounted around a rotary shaft 59, the sprocket rotation being controlled by air actuated clutch 60. Shaft 59 is connected by suitable sprockets, drive chains and gears (not shown) to rotate the rotary table of a drilling rig, the rotary table carrying the Kelly which engages a pipe string in the well through a square Kelly shaft, as is well known in the art.

A cable drum 61 is keyed to shaft 41 at 62 for rotation with the shaft. Drum 61 will normally have an elongate cable (not shown) coiled therearound, the free end of which is disposed through suitable pulleys or sheaves on the top of the derrick and in the derrick and ultimately extends toward the well hole. Therefore, rotation of drum 61 in one direction pays out cable toward the well hole while rotation of drum 61 in the opposite direction withdraws cable from the traveling block which hangs in the derrick above the well hole and pulls or lowers pipe in the hole.

At the end of shaft 41 opposite clutch 43, there is mounted a brake 65 of the type conventionally used with drawworks assemblies, the brake being operated by torque handle 66 shown at the lefthand side of brake flange 65 to terminate paying out of cable from drum 61 or to terminate winding of cable onto drum 61. As will be clear from the drawings, the brake flange 65 and the operating torque handle 66 thereof are located at the drillers side of the drawworks apparatus, to be conveniently accessible to the drilling personnel.

Brake flange 65 is preferably of conventional form, having an outwardly facing cylindrical rim surface about which is disposed a band carrying a plurality of brake blocks having brake material facing the rim. The band is tightened by operation of torque handle 66 to forceably engage the brake blocks with the rim surface. Shaft 41 is journaled for rotation at 68, 69, 70, at walls 11, 16, and 17, respectively.

Shaft 59 is journaled for rotation by suitable bearings at 71, 72.

As has already been mentioned, input shaft 20 is provided with a hydromatic brake 24, operation of which is controlled conventionally by the hydrostatic head in a water vessel (not shown) associated therewith.

Figure 2:
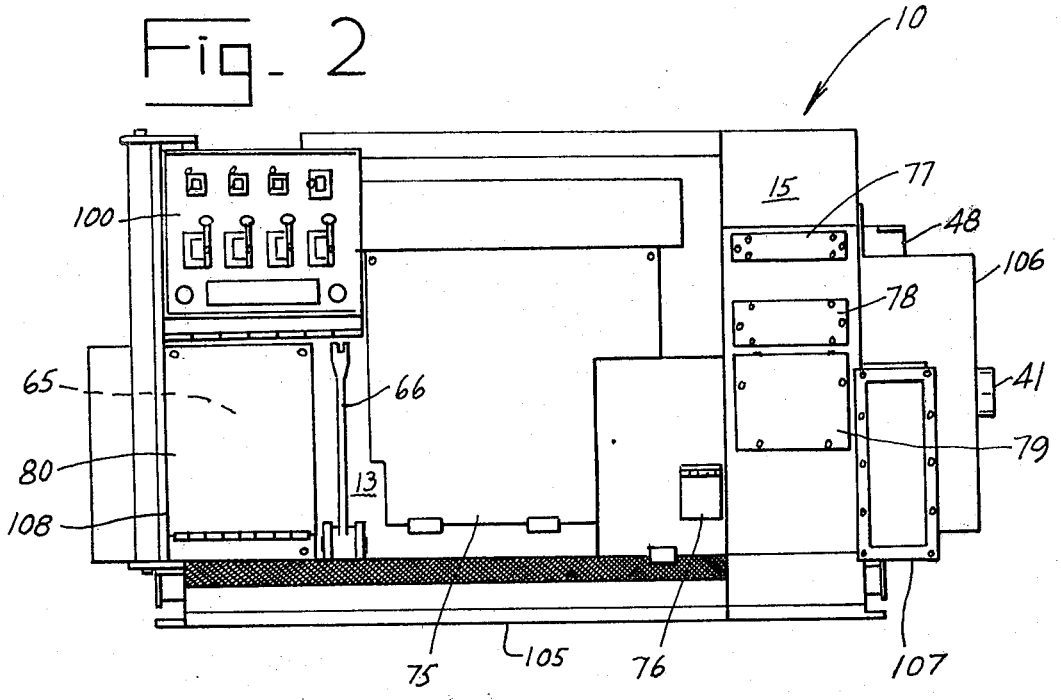
FIG. 2 is a front elevation of the apparatus shown in FIG. 1.
Figure 3:
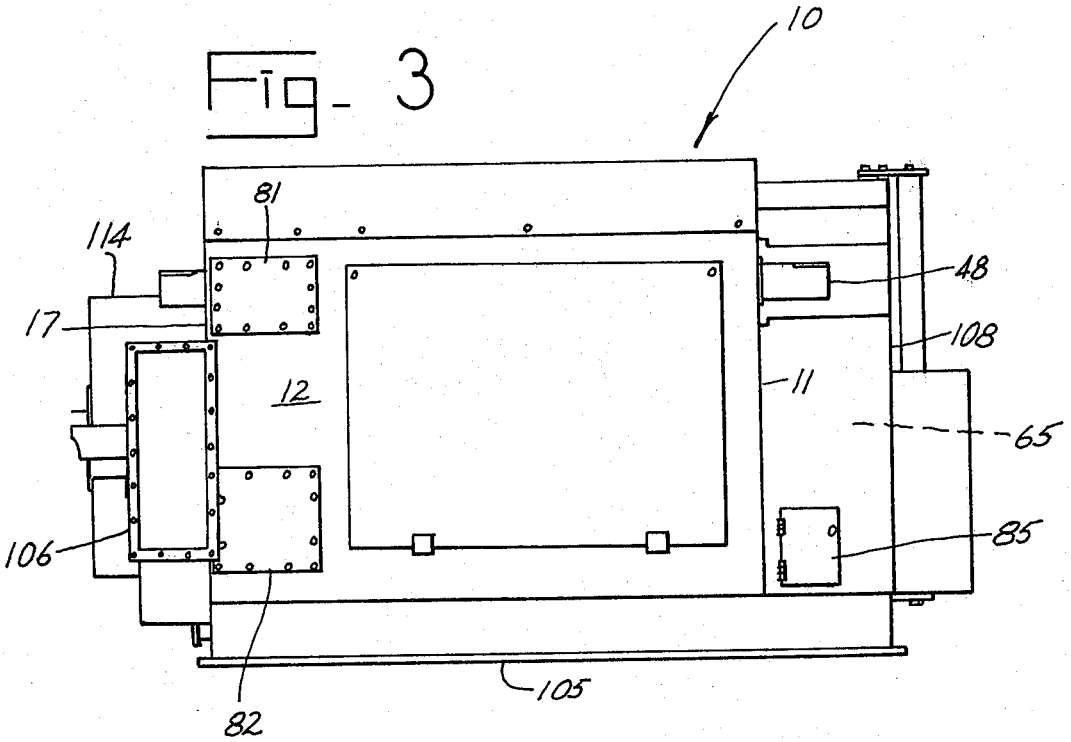
FIG. 3 is a rear elevation of the apparatus shown in FIG. 1.
Figure 4:
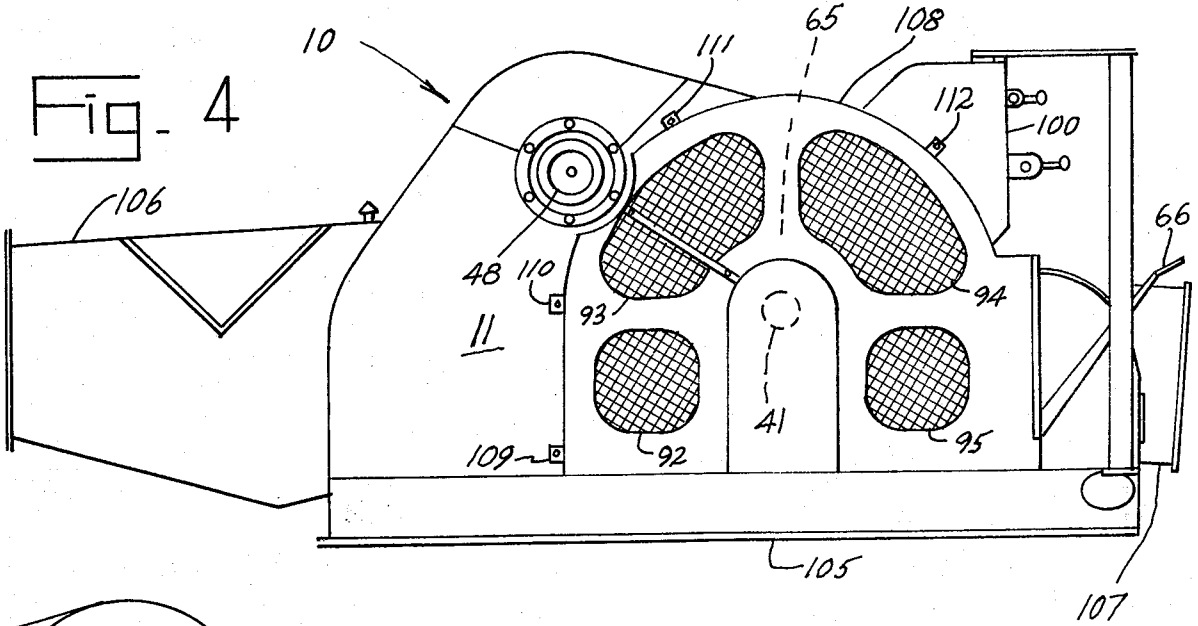
FIG. 4 is a side elevation of the driller's side of the drawworks apparatus.
Figure 5:
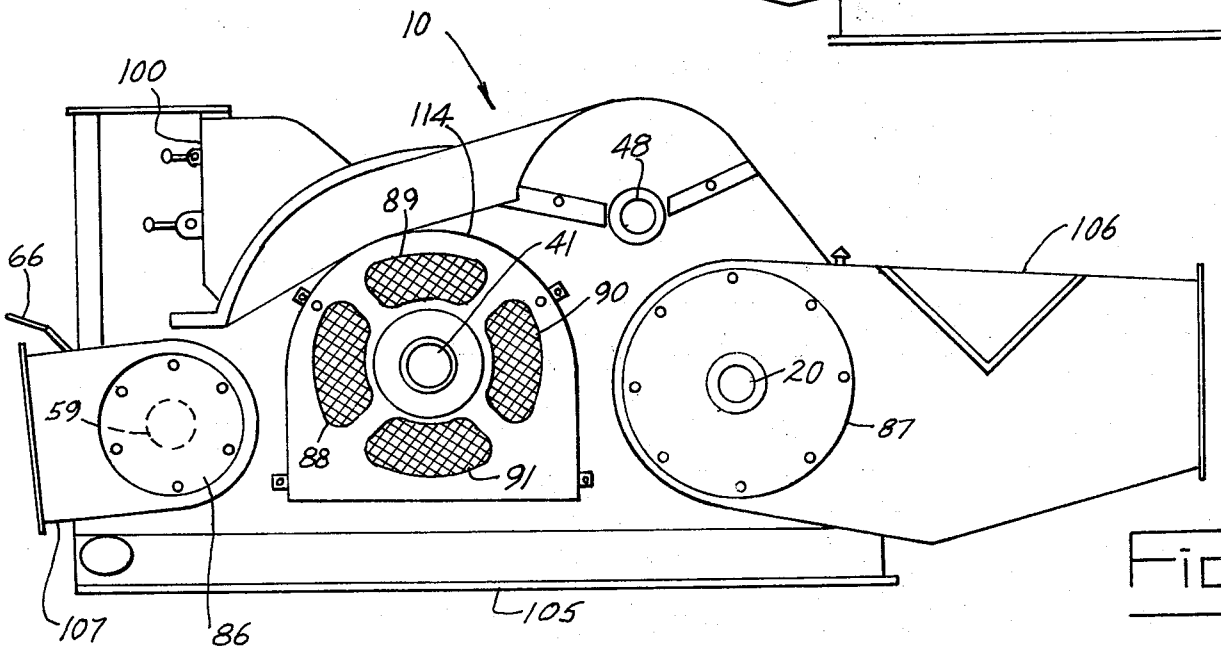
FIG. 5 is a side elevation of the off-driller's side of the drawworks apparatus.

Referring to FIGS. 2–5, the housing 10 is provided with a variety of access doors and panels 75–87, and has screened ventilation openings 88–95. As is indicated in the drawings, the housing 10 is shaped to cover and protect the component elements, and to prevent injury to workmen using the same. An operating console 100 is provided, including control devices for operation of the several clutches and the auxiliary hydromatic brake. The apparatus is supported by a base 105 in the form of a skid to facilitate movement of the apparatus from one location to another. The air and hydraulic lines or conduits employed for operating the clutches and the auxiliary brake are not shown in the drawings.

Guard housing 106 shrouds the input shaft sprockets and drive chains, and guard housing 107 shrouds the rotary shaft sprockets and drive chains. Guard housing 108 shrouds brake 65, and is removable to enable inspection, servicing and repair of the brake by removal of screws 109–112. Since shroud 108 is located at the driller's side, such work can be conveniently accomplished. Guard housing 114 shrouds clutch 43 of the drum shaft.

It should be understood that in conventional drawworks apparatus a second drum shaft brake will be located between the inner end of drum 61 and the housing wall 16. The brake at this location is at an inconvenient location and is awkward to inspect and service. By provision of the single larger brake 65 at the outboard location of the drawworks, the operation of the drawworks is significantly facilitated and improved.

While a preferred embodiment of apparatus has been described and shown in the drawings, many modifications thereof may be made by a person skilled in the art without departing from the spirit of the invention, and it is intended to protect by Letters Patent all forms of the invention falling within the scope of the following claims.

I claim:

1. Drawworks apparatus, comprising a drilling platform supporting said drawworks apparatus, a cable drum, a drum shaft rotatably supporting said cable drum between two upright support wall members, an input shaft and means for driving said input shaft in rotation, clutch controlled chain sprocket and chain transmission means for causing rotations of said drum shaft and cable drum at any of multiple speeds in response to rotations of said input shaft, control apparatus disposed at the outer side of the one of said support wall members which is disposed toward the drilling platform to be readily accessible to the driller for controlling operation of said drawworks apparatus, said drum shaft having an extension beyond said one support wall member, a single outboard brake fixed to said drum shaft extension at the same side of said apparatus as said control apparatus, said brake controlling rotations of said drum shaft and cable drum, said brake being readily accessible from the drilling platform for inspection, service and repair.

2. The combination of claim 1, wherein said drawworks apparatus also includes a cat shaft for use in rotating well pipes for connecting and disconnecting threaded well pipe joints and a rotary shaft for driving the rotary table of a drilling rig in rotation, both said cat shaft and said rotary shaft being driven in rotation by said input shaft through clutch controlled chain sprocket and chain transmission means.

3. The combination of claim 2, wherein said input shaft is provided with a hydromatic brake.

4. Drawworks apparatus, comprising a drilling platform supporting said drawworks apparatus, housing means mounted on said platform adapted to enclose and support the apparatus elements, four spaced parallely disposed shaft means each journaled for rotation within said housing means, a first of said shaft means being the input shaft and extending at one end from one side of said housing means, a second of said shaft means being the cat shaft and extending at both ends from said housing means, a third shaft of said shaft means being the drum shaft and extending between opposite sides of said housing means, a fourth shaft of said shaft means being the rotary shaft and extending from said one side of said housing means, said first shaft having chain sprocket means thereon at said one end outside of said housing means engaging plural drive chains extending from drive means exterior of said apparatus to drive said first shaft in rotation, said first and second shafts having chain sprocket means thereon engaging drive chain means for driving said second shaft in rotation, said first and third shafts having chain sprocket means thereon engaging drive chain means for driving said third shaft in rotation, said third and fourth shafts having chain sprocket means thereon engaging drive chain means for driving said fourth shaft in rotation, said third shaft having cable drum means thereon on which an elongate cable may be wound to form a hoist, said chain sprockets connecting said first and second shafts, said first and third shafts, and said third and fourth shafts being clutch controlled whereby they may be released from their respective shafts, control apparatus for said clutch and brake controls disposed at the control side of said drawworks apparatus which is normally disposed toward said drilling platform to be accessible to the driller, said third shaft having a single outboard brake at an end thereof adjacent said drum means and exterior of said housing means at said control side of said drawworks apparatus whereby said brake is accessible from said platform for inspection, service and repair.

* * * * *